United States Patent [19]

Ishizuka

[11] 3,995,976

[45] Dec. 7, 1976

[54] ROTARY DEVICE WITH AXIALLY BIASED BLADE AND ROTOR SECTIONS

[75] Inventor: Yutaka Ishizuka, Higashimatsuyama, Japan

[73] Assignee: Diesel Kiki Co., Ltd., Tokyo, Japan

[22] Filed: Jan. 29, 1975

[21] Appl. No.: 544,951

[30] Foreign Application Priority Data

Feb. 2, 1974 Japan ..... 49-13963

[52] U.S. Cl. ..... 418/110; 418/111

[51] Int. Cl.[2] ..... F01C 19/00; F03C 3/00; F04C 15/00; F04C 27/00

[58] Field of Search ..... 418/110, 111

[56] References Cited

UNITED STATES PATENTS

| | | | |
|---|---|---|---|
| 428,740 | 5/1890 | Almond | 418/110 |
| 1,582,922 | 5/1926 | Freud | 418/110 |
| 1,721,358 | 7/1929 | Struble | 418/110 |
| 1,972,744 | 9/1934 | Lister | 418/110 |
| 2,791,284 | 5/1957 | Jackson | 418/111 |
| 2,831,631 | 4/1958 | Petersen | 418/111 |

FOREIGN PATENTS OR APPLICATIONS

| | | | |
|---|---|---|---|
| 881,246 | 1/1943 | France | 418/110 |

*Primary Examiner*—John J. Vrablik
*Attorney, Agent, or Firm*—Frank J. Jordan

[57] ABSTRACT

A rotor is eccentrically journalled for rotation within a bore of a stationary housing formed with end walls and inlet and outlet ports. One or more blades are radially slidable within grooves in the rotor and biased into sealing engagement with the inner circumference of the housing. Rotation of the rotor and blades produces suction and pressure chambers within the housing to displace fluid from the inlet to the outlet. The rotor and blades are each formed in two sections with a resilient member inserted inbetween, the resilient members urging the respective sections longitudinally into sealing engagement with the end walls.

10 Claims, 7 Drawing Figures

ROTARY DEVICE WITH AXIALLY BIASED BLADE AND ROTOR SECTIONS

The present invention relates to a fluid displacement device which may be a pump, compressor or motor, and especially to an improved rotor and blade assembly for a fluid displacement device.

A fluid displacement device which is well known in the prior art comprises a bored housing in which a rotor is eccentrically journalled. Blades are radially slidable in grooves in the circumference of the rotor and urged into sealing engagement with the inner circumference of the housing by a spring and centrifugal force. The housing is formed with a fluid inlet and outlet. If fluid is fed into the inlet, the rotor will be forced to rotate. The fluid will be displaced by the rotor and blades to the outlet and out of the housing. The device will thus function as a fluid motor. If the rotor is driven for rotation by a motor, suction and pressure chambers of varying volume will be defined within the housing which will cause fluid to be sucked in the inlet, compressed and displaced within the housing to the outlet and pumped out of the housing. The device thus can also function as a pump or compressor. When such a device is arranged to operate as a compressor, it may be very advantageously utilized in a refrigeration or air conditioning system to compress refrigerant gas.

A major problem, however, is inherent in this prior art device. Although the blades are urged radially into sealing engagement with the inner circumference of the housing, the blades and the rotor are of a fixed length. If the rotor and blades are designed to be shorter than the distance between the inner surfaces of end plates fixed to the housing to seal the ends of the bore and support the rotor, fluid may pass through clearances between the ends of the blades and rotor and the surfaces of the end plates between suction and pressure chambers within the housing. The efficiency of the device is thereby severely degraded.

On the other hand, if the blades and rotor are made longer so as to tightly fit between the end plates, and provide a good seal, heat generated by friction during the operation of the device will cause the blades and rotor to expand and abrade themselves and the end plates. In the worst cases, the friction between the blades and rotor and the end plates may become so extreme that the blades and rotor may burn, or the rotor may seize within the housing.

It is therefore an important object of the present invention to provide a fluid displacement device, which may be arranged to operate as a pump, compressor or motor, in which effective sealing between the blades, rotor and end plates of the device is maintained under all operating conditions of the device.

It is another object of the invention to provide a fluid displacement device of the type described above in which burning and seizing of a rotor and blade assembly within a housing is effectively prevented.

It is another object of the present invention to provide a rotor and blade assembly in which the rotor and blades are each formed in two sections with a resilient member inserted therebetween.

The above and other objects, features and advantages of the present invention will become apparent from the following detailed description taken with the accompanying drawings, in which.

Figure 1:
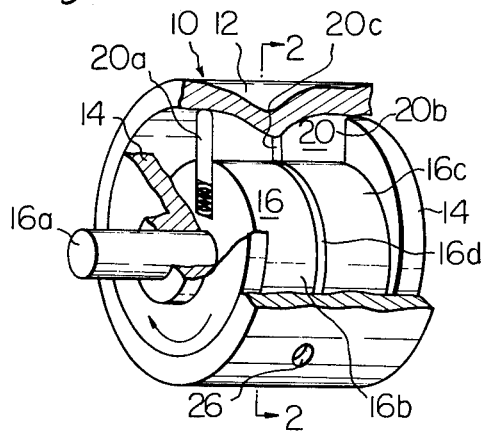
FIG. 1 is a perspective view, partly cut away, of a fluid displacement device embodying the present invention.

Referring now to FIG. 1, a fluid displacement device embodying the present invention, which may be a pump, compressor or motor, comprises a stator or housing 10 which is made of a bored casing 12 and end plates or walls 14 closing the ends of the bore of the casing 12. A rotor, generally designated as 16, includes a shaft **16*a* which is eccentrically journalled by means of bearings (no numerals) at the end walls 14 for rotation within the housing 10. Two rotor sections 16*b* and 16*c* are coaxially splined on the shaft 16*a*, and a resilient member 16*d* is inserted between the sections 16*b* and 16*c*.**

Figure 2:
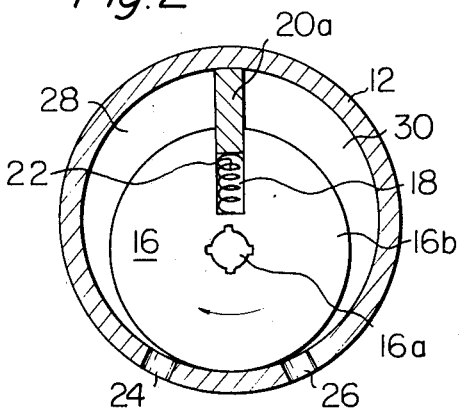
FIG. 2 is a section on a line X—X of FIG. 1.

A radial rectangular groove or slot 18 (see FIG. 2) is formed in the periphery of both the sections **16*b* and 16*c* of the rotor 16, and sections 20*a* and 20*b* of a blade 20 are slidable therein. The edges of the sections 2o*a* and 20*b* are urged external of the slot 18 by springs 22 and centrifugal force to substantially sealingly contact the inner circumference of the casing 12, and are shaped to conform therewith. A fluid inlet 24 and a fluid outlet 26 are formed through the wall of the casing 12, and the circumference of the rotor 16 is in substantial sealing contact with the inner circumference of the casing 12 at a point between the inlet 24 and outlet 26. The axis of the rotor 16 is parallel to the axis of the bore of the casing 12, so that the contact between the rotor 16 and the casing 12 is along a line parallel to the bore of the casing 12. The rotor 16 and the blade 20 define a suction chamber 28 and a pressure chamber 30 within the housing 10, which are shown in FIG. 2.**

The profiles of the bore of the casing 12 and the sections **16*b* and 16*c* of the rotor 16 are shown as being circular, but the bore and rotor sections may be of any right cylindrical shape such as a trochoid or limacon. The present invention is therefore applicable to a wide variety of fluid displacement devices which are well known to those skilled in the art, and is not limited to the specific configuration shown. It will be appreciated that any number of blades may be provided to the rotor 16, although only one is shown. Also, the rotor 16 and blade 20** may be formed in more than two sections with a resilient member inserted between each two sections.

The resilient members **16*d* and 20*c* are in a state of compression between the sections 16*b* and 16*c* and the sections 20*a* and 20*b* respectively to urge the edges of the sections against the inner surfaces of the end walls 14 to sealingly contact therewith. The stiffness and dimensions of the resilient members 16*d* and 20*c* are selected so that the ends of the sections of the blade 20 and the rotor 16 are urged against the end walls 14 with a pressure sufficient to provide a good seal but insufficient to enable burning or seizing of the blade 20 of rotor 16 within the housing 10. The resilient members 16*d* and 20*c*** may be formed of a resilient rubber or plastic material or the like, or may be leaf or coil springs.

Figure 3:
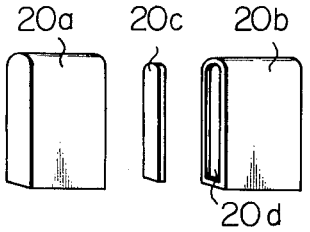
FIG. 3 is an exploded view of a blade shown in FIG. 1.

Referring now to FIG. 3, a recess 20*d* may be formed in the end of the section 20*b* facing the section 20*a* as shown to retain the resilient member 20*c*. A similar recess may be formed in the end of the section 20*a* if desired, although not shown.

Figure 4:
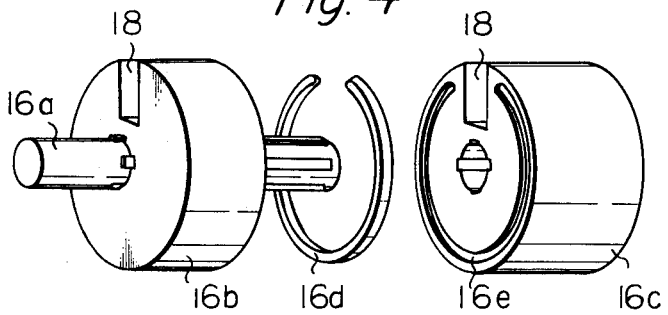
FIG. 4 is an exploded view of a rotor shown in FIG. 1.

Referring now to FIG. 4, the resilient member 16*d* is shown as being in the form of a broken annulus, with the slot 18 extending through the break in the annulus. A broken annular groove 16*e* may be formed in the end of the section 16*c* facing the section 16*b* to retain the resilient member 16*d*, and a similar groove may be formed in the end of the section 16*b* if desired.

Figure 5:
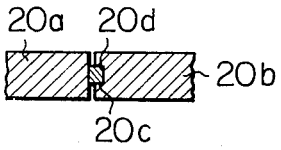
FIG. 5 is a section of the blade shown in FIG. 3.

Referring now to FIG. 5, it will be seen that due to the thickness of the resilient member 20*c*, a gap or clearance is formed between the adjacent ends of the sections 20*a* and 20*b*. However, it has been determined in practice that this gap may be made so small that it will not degrade the performance of the device. This gap may be eliminated completely by modifications of the sections 20*a* and 20*b* as shown in FIGS. 6 and 7, in which the adjacent ends of the sections are stepped in an overlapping arrangement.

Figure 6:
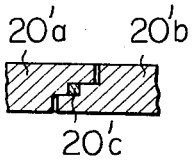
FIG. 6 is a sectional view illustrating a modified form of the blade shown in FIG. 3.
Figure 7:
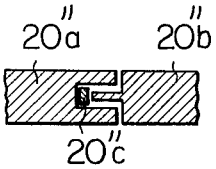
FIG. 7 is similar to FIG. 6 but illustrates another modification to the blade.

In FIG. 6, the sections 2'*a* and 20'*b* are formed at their adjacent ends with conjugate steps (no numerals) so that the resilient member 20'*c* is completely enclosed and the profile of the tip of the blade is unbroken. The same result may be obtained by the modification shown in FIG. 7, in which the steps of the section 20''*a* define therebetween a slot whereas the steps of the section 20''*b* define a tongue adapted to engage in the slot of the section 20''*a* to enclose the resilient member 20''*c*.

When the device is arranged to operate as a pump or compressor, the inlet 24 is connected to a fluid reservoir, which may be the atmosphere in the case of air pump or compressor. The outlet 26 is connected to a load (not shown) which may be any suitable device. The shaft 16*a* is driven by a motor or other drive means (not shown) as indicated by an arrow in the drawings.

As the rotor 16 and blade 20 rotate, the volume of the pressure chamber 30 decreases so that the fluid in the pressure chamber 30 is compressed and forced out the outlet 26. Simultaneously, the volume of the suction chamber 28 increases so that fluid is sucked thereinto through the inlet 24. In this manner, fluid is compressed by the device and displaced from the inlet 24 to the outlet 26 in an operable and useful manner.

When the device is arranged to operate as a fluid motor, the inlet 24 is connected to a source of high pressure fluid and the outlet 26 to a fluid reservoir (not shown). The shaft 16*a* is connected to drive a load (not shown). High pressure fluid in the chamber 28 forces the rotor 16 and blade 20 to rotate and displace the fluid in the chamber 30 out the outlet 26, thus producing useful mechanical output power.

Depending on the operating temperature, pressure and other practical design factors which may vary widely in various applications, either one or both of the rotor and the blade may be formed in two sections with a resilient member inserted inbetween. It will nevertheless be appreciated that whether the device is arranged to operate as a pump, compressor or fluid motor, the novel aspect of the present invention, which resides in forming the rotor and/or blade in sections with resilient members inbetween biasing the edges of the sections into sealing engagement with the end walls of the housing, provides a superior seal between the rotor, blade and housing and effectively prevents burning and seizing of the rotor within the housing.

What is claimed is:

1. In a fluid displacement device including a housing having a bore, end walls to close the ends of said bore and fluid inlet and outlet ports, a rotor mounted for rotation within said bore and having a longitudinal groove, a blade fitted in said groove and substantially sealingly contacting the inner circumference of said housing, said rotor and blade being rotatable within said housing to displace fluid from said inlet to said outlet, two longitudinal sections provided on said rotor;

a resilient member inserted between said two sections to urge said sections toward said respective end walls to sealingly contact therewith, said resilient member being in the form of a broken annulus; and a recess having a break formed in the end of one of said two sections adjacent to the other section to retain the resilient member, said resilient member being provided in the recess in the end of said section of said rotor, said longitudinal groove of said rotor extending through the break in said recess.

2. The device according to claim 1, in which said resilient member is made of rubber.

3. The device according to claim 1, in which said resilient member is made of a plastic material.

4. The device according to claim 1, in which two sections are provided on said blade, the adjacent ends of said two sections of said blade being stepped in an overlapping arrangement with a resilient member inserted therebetween.

5. The device according to claim 1, which is arranged to operate as a fluid motor.

6. The device according to claim 1, which is arranged to operate as a pump or compressor.

7. The device according to claim 1, wherein said resilient member in said recess contacts a generally flat and non-recessed portion of said other section.

8. The device according to claim 1, in which said blade is radially slidable in said groove and urged into contact with the inner circumference of said housing, and said rotor being eccentrically mounted for rotation within said bore.

9. The device according to claim 8, in which said rotor contacts the inner circumference of said housing along a line parallel to the axis of said bore.

10. The device according to claim 8, in which the shapes of said bore and said rotor are right cylinders.

* * * * *